US005705053A

United States Patent [19]

Buchanan

[11] Patent Number: 5,705,053

[45] Date of Patent: Jan. 6, 1998

[54] FCC REGENERATOR $NO_x$ REDUCTION BY HOMOGENEOUS AND CATALYTIC CONVERSION

[75] Inventor: John Scott Buchanan, Trenton, N.J.

[73] Assignee: Mobil Oil Corporation, Fairfax, Va.

[21] Appl. No.: 521,180

[22] Filed: Aug. 30, 1995

[51] Int. Cl.[6] ..... C10G 11/00; C01B 21/02

[52] U.S. Cl. ..... 208/113; 208/120; 423/235; 502/38

[58] Field of Search ..... 208/113, 120; 423/235; 502/38

[56] References Cited

U.S. PATENT DOCUMENTS 4,405,587 9/1983 McGill et al. ..... 423/235
4,519,993 5/1985 McGill et al. ..... 423/235
5,021,144 6/1991 Alrichter ..... 208/113
5,240,690 8/1993 Tang et al. ..... 208/113
5,268,089 12/1993 Avidan et al. ..... 208/113
5,372,706 12/1994 Buchanan et al. ..... 423/235

*Primary Examiner*—Walter D. Griffin
*Attorney, Agent, or Firm*—Robert B. Furr, Jr.; Malcolm D. Keen

[57] ABSTRACT

Oxides of nitrogen ($NO_x$) emissions from an FCC regenerator are reduced by operating the regenerator in partial CO burn mode and controlled thermal and catalytic processing of the flue gas. Partial CO burn FCC catalyst regeneration produces flue gas with CO and $NO_x$ precursors. Air is added and most $NO_x$ precursors homogeneously converted while leaving some CO unconverted. Downstream catalytic conversion then reduces produced $NO_x$ with unconverted CO.

20 Claims, 1 Drawing Sheet

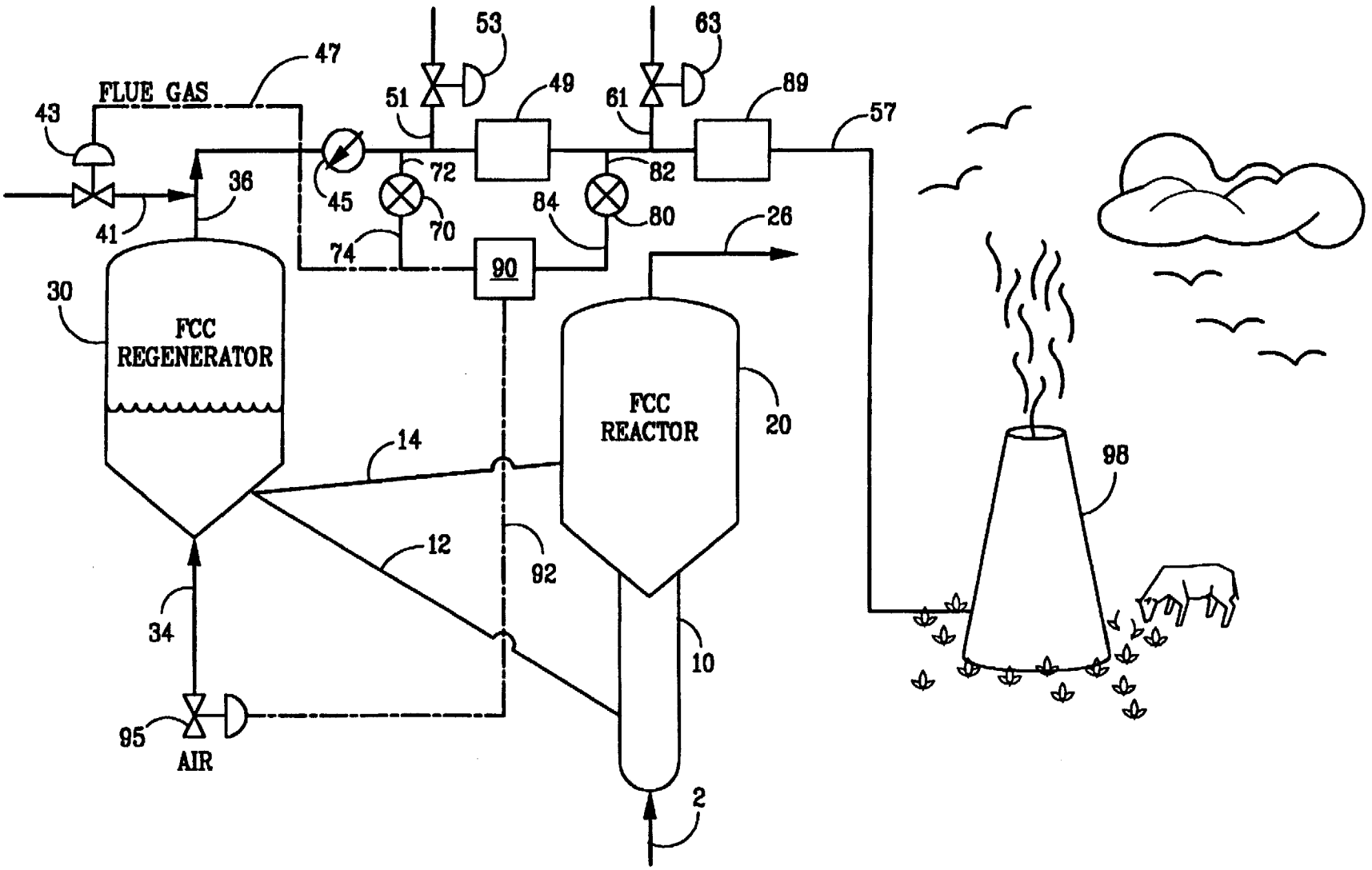
FCC REACTOR
FCC REGENERATOR
FLUE GAS
AIR
2
10
12
14
20
26
30
34
36
41
43
45
47
49
51
53
57
61
63
70
72
74
80
82
84
89
90
92
95
98

FCC REGENERATOR $NO_X$ REDUCTION BY HOMOGENEOUS AND CATALYTIC CONVERSION

BACKGROUND OF THE INVENTION

1. FIELD OF THE INVENTION

The invention relates to regeneration of spent catalyst from an FCC unit.

2. DESCRIPTION OF RELATED ART $NO_x$, or oxides of nitrogen, in flue gas streams from FCC regenerators is a pervasive problem. FCC units process heavy feeds containing nitrogen compounds, and some of this material is eventually converted into $NO_x$ emissions, either in the FCC regenerator (if operated in full CO burn mode) or in a downstream CO boiler (if operated in partial CO burn mode). Thus all FCC units processing nitrogen containing feeds can have a $NO_x$ emissions problem due to catalyst regeneration, but the type of regeneration employed (full or partial CO burn mode) determines whether $NO_x$ emissions appear sooner (regenerator flue gas) or later (CO boiler).

Although there may be some nitrogen fixation, or conversion of nitrogen in regenerator air to $NO_x$, most $NO_x$ emissions are believed to come from oxidation of nitrogen compounds in the feed.

Several powerful ways have been developed to deal with the problem. The approaches fall into roughly five categories:

1. Feed hydrotreating, to keep $NO_x$ precursors from the FCC unit.
2. Segregated cracking of fresh feed.
3. Process and hardware approaches which reduce the $NO_x$ formation in a regenerator in complete CO burn mode, via regenerator modifications.
4. Catalytic approaches, using a catalyst or additive which is compatible with the FCC reactor, which suppress $NO_x$ formation or catalyze its reduction in a regenerator in complete CO burn mode.
5. Stack gas cleanup methods which are isolated from the FCC process.

The FCC process will be briefly reviewed, followed by a review of the state of the art in reducing $NO_x$ emissions.

FCC PROCESS

Catalytic cracking of hydrocarbons is carried out in the absence of externally added $H_2$ in contrast to hydrocracking, in which $H_2$ is added during the cracking step. An inventory of particulate catalyst continuously cycles between a cracking reactor and a catalyst regenerator. In FCC, hydrocarbon feed contacts catalyst in a reactor at 425° C.–600° C., usually 460° C.–560° C. The hydrocarbons crack, and deposit carbonaceous hydrocarbons or coke on the catalyst. The cracked products are separated from the coked catalyst. The coked catalyst is stripped of volatiles, usually with steam, and is then regenerated. In the catalyst regenerator, the coke is burned from the catalyst with oxygen-containing gas, usually air. Coke burns off, restoring catalyst activity and heating the catalyst to, e.g., 500° C.–900° C., usually 600° C.–750° C. Flue gas formed by burning coke in the regenerator may be treated to remove particulates and convert carbon monoxide, after which the flue gas is normally discharged into the atmosphere.

Most FCC units now use zeolite-containing catalyst having high activity and selectivity. These catalysts are believed to work best when coke on catalyst after regeneration is relatively low.

Two types of FCC regenerators are commonly used, the high efficiency regenerator and the bubbling bed type.

The high efficiency regenerator mixes recycled regenerated catalyst with spent catalyst, burns much of the coke in a fast fluidized bed coke combustor, then discharges catalyst and flue gas up a dilute phase transport riser where additional coke combustion may occur and CO is afterburned to $CO_2$. These regenerators are designed for complete CO combustion and usually produce clean burned catalyst and flue gas with little CO and modest amounts of $NO_x$.

The bubbling bed regenerator maintains the catalyst as a bubbling fluidized bed, to which spent catalyst is added and from which regenerated catalyst is removed. These usually have more catalyst inventory in the regenerator because gas/catalyst contact is not as efficient in a bubbling bed as in a fast fluidized bed.

Many bubbling bed regenerators operate in complete CO combustion mode, i.e., the mole ratio of $CO_2/CO$ is at least 10. Many refiners burn CO completely in the catalyst regenerator to conserve heat and to minimize air pollution.

Many refiners add a CO combustion promoter metal to the catalyst or to the regenerator. U.S. Pat. No. 2,647,860 proposed adding 0.1 to 1 weight percent chromic oxide to a cracking catalyst to promote combustion of CO. U.S. Pat. No. 3,808,121, taught using relatively large-sized particles containing CO combustion-promoting metal into a regenerator. The small-sized catalyst cycled between the cracking reactor and the catalyst regenerator while the combustion-promoting particles remain in the regenerator.

U.S. Pat. Nos. 4,072,600 and 4,093,535 taught use of Pt, Pd, Ir, Rh, Os, Ru and Re in cracking catalysts in concentrations of 0.01 to 50 ppm, based on total catalyst inventory. Most FCC units now use Pt CO combustion promoter. This reduces CO emissions, but usually increases nitrogen oxides ($NO_x$) in the regenerator flue gas.

It is difficult in a catalyst regenerator to burn completely coke and CO in the regenerator without increasing the $NO_x$ content of the regenerator flue gas. Many jurisdictions restrict the amount of $NO_x$ that can be in a flue gas stream discharged to the atmosphere. In response to environmental concerns, much effort has been spent on finding ways to reduce $NO_x$ emissions.

The $NO_x$ problem is acute in bubbling dense bed regenerators, perhaps due to localized high oxygen concentrations in the large bubbles of regeneration air. Even high efficiency regenerators, with better catalyst/gas contacting, produce significant amounts of $NO_x$, though usually about 50–75% of the $NO_x$ produced in a bubbling dense bed regenerator cracking a similar feed.

Much of the discussion that follows is generic to any type of regenerator while some is specific to bubbling dense bed regenerators, which have the most severe $NO_x$ problems.

FEED HYDROTREATING

Some refiners hydrotreat feed. This is usually done to meet sulfur specifications in products or a $SO_x$ limit in regenerator flue gas, rather than a $NO_x$ limitation. Hydrotreating removes some nitrogen compounds in FCC feed, and this reduces $NO_x$ emissions from the regenerator.

SEGREGATED FEED CRACKING

U.S. Pat. No. 4,985,133, Sapre et al, incorporated by reference, taught reducing $NO_x$ emissions, and improving performance in the cracking reactor, by keeping high and low nitrogen feeds segregated, and adding them to different elevations in the FCC riser.

PROCESS AND HARDWARE APPROACHES TO $NO_x$ CONTROL

Process modifications are suggested in U.S. Pat. No. 4,413,573 and U.S. Pat. No. 4,325,833, to two-and three-stage FCC regenerators, which reduce $NO_x$ emissions.

U.S. Pat. No. 4,313,848 taught countercurrent regeneration of spent FCC catalyst without backmixing minimized $NO_x$ emissions.

U.S. Pat. No. 4,309,309 taught adding fuel vapor to the upper portion of an FCC regenerator to minimize $NO_x$. Oxides of nitrogen formed in the lower portion of the regenerator were reduced by burning fuel in upper portion of the regenerator.

U.S. Pat. No. 4,542,114 taught minimizing the volume of flue gas by using oxygen rather than air in the FCC regenerator. This reduced the amount of flue gas produced.

In Green et al, U.S. Pat. No. 4,828,680, incorporated by reference, $NO_x$ emissions from an FCC unit were reduced by adding sponge coke or coal to the circulating inventory of cracking catalyst. The coke absorbed metals in the feed and reduced $NO_x$ emissions. Many refiners are reluctant to add coal or coke to their FCC units, as such materials burn and increase heat release in the regenerator.

DENO$_x$ WITH COKE

U.S. Pat. No. 4,991,521 Green and Yan used coke on spent FCC catalyst to reduce $NO_x$ emissions. Flue gas from a second stage of regeneration contacted coked catalyst in a first stage. Although reducing $NO_x$ emissions this approach is not readily adaptable to existing units.

DENO$_x$ WITH REDUCING ATMOSPHERES

Another approach to reducing $NO_x$ emissions is to create a reducing atmosphere in part of the regenerator by segregating the CO combustion promoter. U.S. Pat. Nos. 4,812,430 and 4,812,431 used as CO combustion promoter Pt on a support which "floated" or segregated in the regenerator. Large, hollow, floating spheres gave a sharp segregation of CO combustion promoter in the regenerator and this helped reduce $NO_x$ emissions.

CATALYTIC APPROACHES TO $NO_x$ CONTROL

The work that follows is generally directed at catalysts which burn CO but do not promote formation of $NO_x$.

U.S. Pat. No. 4,300,997 and U.S. Pat. No. 4,350,615, use Pd-Ru CO-combustion promoter. The bi-metallic CO combustion promoter is reported to do an adequate job of converting CO while minimizing $NO_x$ formation.

U.S. Pat. No. 4,199,435 suggests steaming metallic CO combustion promoter to decrease $NO_x$ formation without impairing too much the CO combustion activity of the promoter.

U.S. Pat. No. 4,235,704 suggests that in complete CO combustion mode too much CO combustion promoter causes $NO_x$ formation in FCC. Monitoring the $NO_x$ content of the flue gas and adjusting the amount of CO combustion promoter in the regenerator based on $NO_x$ in the flue gas is suggested. As an alternative to adding less Pt the patentee suggests deactivating Pt in place by adding lead, antimony, arsenic, tin or bismuth.

U.S. Pat. No. 5,002,654, Chin, incorporated by reference, taught a zinc based additive for reducing $NO_x$. Relatively small amounts of zinc oxides impregnated on a separate support with little cracking activity produced an additive circulated with the FCC E-cat and reduced $NO_x$ emissions.

U.S. Pat. No. 4,988,432 Chin, incorporated by reference, taught an antimony based additive for reducing $NO_x$.

Many refiners are reluctant to add metals to their catalyst out of environmental concerns. Zinc may vaporize under conditions experienced in some FCC units. Antimony addition may make disposal of spent catalyst more difficult.

Such additives add to the cost of the FCC process, may dilute the E-cat and may not be as effective as desired.

In addition to catalytic approaches, there are hybrid approaches involving catalyst and process modifications.

U.S. Pat. No. 5,021,144, Altrichter, taught operating the regenerator in partial CO burn mode with excess Pt on E-cat. Adding excess Pt reduced $NO_x$ in the CO boiler stack gas. This is similar to a refiner operating in partial CO burn mode with excess Pt to ensure stable operation.

U.S. Pat. No. 5,268,089, Avidan et. al, incorporated by reference, taught reducing $NO_x$ emissions by running the FCC regenerator between full and partial CO burn mode with combustion of CO containing flue gas in a downstream CO boiler. Although a CO boiler was preferred the patent mentioned use of Pt gauze, or honeycombs coated with Pt or similar CO combustion promoter to reduce CO emissions. Avidan's "uncomfortable" mode of regenerator operation made it possible to burn $NO_x$ precursors to $N_2$ in the generally reducing atmosphere of the FCC regenerator. The flue gas from the CO boiler had less $NO_x$ than if the regenerator were run in full CO burn mode or partial CO burn mode with a CO boiler.

The '089 approach provides a good way to reduce $NO_x$ emissions, but some refiners want even greater reductions, or are reluctant to operate their FCC regenerator in such an "uncomfortable" region which is difficult to control. Some may simply want the ability to operate their FCC regenerators solidly in the partial CO burn region, which makes the FCC unit as a whole much more flexible.

Considerable effort has also been spent on downstream treatment of FCC flue gas. This area will be reviewed next.

STACK GAS TREATMENT

First it should be mentioned that FCC regenerators present special problems. FCC regenerator flue gas will usually have large amounts, from 4 to 12 mole %, of steam, and significant amounts of sulfur compounds. The FCC environment changes constantly, and relative amounts of $CO/O_2$ can and do change rapidly.

The FCC unit may yield reduced nitrogen species such as ammonia or oxidized nitrogen species such as $NO_x$. In some units, especially bubbling dense bed regenerators, both oxidized and reduced nitrogen contaminant compounds are present at the same time. It is as if some portions of the regenerator have an oxidizing atmosphere, and other portions have a reducing atmosphere.

Bubbling bed regenerators may have reducing atmospheres where spent catalyst is added, and oxidizing atmospheres in the large bubbles of regeneration air passing through the catalyst bed. Even if air distribution is perfectly synchronized with spent catalyst addition at the start-up of a unit, something will usually change during the course of normal operation which upset the balance of the unit. Typical upsets include changes in feed rate and composition, air distribution nozzles in the regenerator which break off, and slide valves and equipment that erode over the course of the 1–3 year run length of the FCC unit operation.

Any process used for FCC regenerator flue gas must be able to deal with the poisons and contaminants, such as sulfur compounds, which are inherent in FCC operation. The process must be robust and tolerate great changes in flue gas composition. Ideally, the process should be able to oxidize reduced nitrogen species and also have the capability to reduce oxidized nitrogen species which may be present.

Stack gas treatments have been developed which reduce $NO_x$ in flue gas by reaction with $NH_3$. $NH_3$ is a selective reducing agent which does not react rapidly with the excess oxygen which may be present in the flue gas. Two types of $NH_3$ process have evolved, thermal and catalytic.

Thermal processes, e.g. the Exxon Thermal DeNO$_x$ process, operate as homogeneous gas-phase processes at 1550°–1900° F. More details are disclosed by Lyon, R. K., Int. J. Chem. Kinet., 3, 315, 1976, incorporated by reference.

Catalytic systems have been developed which operate at lower temperatures, typically at 300°–850° F.

U.S. Pat. Nos. 4,521,389 and 4,434,147 disclose adding $NH_3$ to flue gas to reduce catalytically the $NO_x$ to nitrogen.

U.S. Pat. No. 5,015,362, Chin, incorporated by reference, taught contacting flue gas with sponge coke and a catalyst promoting reduction of $NO_x$ around such carbonaceous substances.

None of the approaches described is the perfect solution.

Feed pretreatment is expensive, and usually only justified for sulfur removal. Segregated feed cracking helps but requires segregated high and low nitrogen feeds.

Multi-stage or countercurrent regenerators reduce $NO_x$ but require extensive rebuilding of the FCC regenerator.

Catalytic approaches, e.g., adding lead or antimony, to degrade Pt, help some but may not meet stringent $NO_x$ emissions limits set by local governing bodies. Stack gas cleanup is powerful, but the capital and operating costs are high.

The approach disclosed in U.S. Pat. No. 5,268,089 gave a good way to reduce $NO_x$ emissions with little additional cost, but a refiner did not have as much flexibility in operating the FCC unit and this approach did not always reduce $NO_x$ to the extent desired. Of particular concern to many refiners was the difficulty of maintaining the regenerator "on the brink"—an uncomfortable operation of the FCC regenerator. While the $NO_x$ reductions are substantial, the unit is hard to control because classical control methods no longer work. Adding more air might cool the regenerator (by dilution) or heat it (if the regenerator was somewhat in partial combustion mode).

I wanted a better way to reduce $NO_x$ emissions associated with FCC regenerators. I liked the approach disclosed in '089, but wanted more $NO_x$ reduction and wanted to give refiners more flexibility in operating their units. I also wanted to shift at least some heat generation out of the FCC regenerator to a downstream CO boiler or the like, so that heavier feeds could be cracked in the FCC unit.

I discovered a way to operate the FCC regenerator solidly in partial CO burn mode, producing flue gas with at least 1 mole % CO, and preferably with 2 mole % CO, plus or minus 1 mole % CO, and large amounts of $NO_x$ precursors. I homogeneously convert the $NO_x$ precursors with substoichiometric oxygen. The oxygen source can be excess oxygen in the flue gas, added air, added oxygen and/or any oxygen containing oxidation agent. This converts most of the $NO_x$ precursors to $NO_x$, but leaves significant amounts of CO present. The formed $NO_x$ is then catalytically reduced with the native CO to produce a flue gas which, after complete CO combustion, has less than half as much $NO_x$ as a prior art process simply using a CO boiler.

BRIEF SUMMARY OF THE INVENTION

Accordingly the present invention provides a catalytic cracking process for cracking a nitrogen containing hydrocarbon feed comprising cracking said feed in a cracking reactor with a source of regenerated cracking catalyst to produce catalytically cracked products which are removed as a product and spent catalyst containing nitrogen containing coke, regenerating said spent catalyst in a catalyst regenerator by contact with a controlled amount of air or oxygen-containing regeneration gas at regeneration conditions to produce regenerated catalyst which is recycled to said cracking reactor and regenerator flue gas, removing a regenerator flue gas stream comprising volatilized $NO_x$ precursors, at least 1 mole % carbon monoxide and more carbon monoxide than oxygen, molar basis, adding air or oxygen containing gas to regenerator flue gas to produce oxygen enriched flue gas, homogeneously converting at least 50 mole % of volatilized $NO_x$ precursors, but less than 50 mole % of said CO, in said oxygen enriched flue gas in a non-catalytic conversion zone to produce homogeneously converted flue gas containing produced $NO_x$ and CO; and catalytically reducing $NO_x$ in said homogeneously converted flue gas in a catalytic $NO_x$ reduction reactor containing a $NO_x$ reduction catalyst by reaction with said CO in said homogeneously converted flue gas to produce product gas with a reduced CO content relative to said regenerator flue gas and a reduced $NO_x$ content as compared to the $NO_x$ content of a like regenerator flue gas oxidized in a CO boiler to said reduced CO content.

In another embodiment, the present invention provides a fluidized catalytic cracking process for cracking a nitrogen containing hydrocarbon feed comprising cracking said feed in a fluidized catalytic cracking (FCC) reactor with a source of regenerated cracking catalyst to produce catalytically cracked products which are removed as a product and spent catalyst containing nitrogen containing coke, regenerating said spent catalyst in a bubbling fluidized bed catalyst regenerator with air or oxygen-containing regeneration gas at regeneration conditions to produce regenerated catalyst which is recycled to said cracking reactor and regenerator flue gas, removing from said regenerator a regenerator flue gas stream comprising less than 1 mole % oxygen, at least 2 mole carbon monoxide, at least 100 ppmv of HCN and/or $NH_3$ or mixtures thereof, adding air or oxygen containing gas to regenerator flue gas to produce oxygen enriched flue gas and controlling oxygen addition so the oxygen enriched flue gas has at least a 2:1 carbon monoxide:oxygen mole ratio, thermally converting at least 50 mole % of the total amount of said HCN and $NH_3$ but less than 50 mole % of said CO in a non-catalytic, thermal conversion zone to produce converted flue gas having at least 1 mole % CO and $NO_x$ produced as a result of said thermal conversion and catalytically reducing $NO_x$ in said converted flue gas in a catalytic $NO_x$ reduction reactor containing a $NO_x$ reduction catalyst with said CO to produce product gas with a reduced CO content relative to regenerator flue gas and a reduced $NO_x$ content compared to a like regenerator flue gas oxidized in a CO boiler to said reduced CO content.

Other embodiments relate to preferred catalysts and process conditions.

BRIEF DESCRIPTION OF THE DRAWING

FIG. 1 shows a simplified process flow diagram of an FCC unit with a homogeneous flue gas $NO_x$ precursor converter, a catalytic $NO_x$ converter and a CO boiler.

DETAILED DESCRIPTION

The present invention is ideal for use with a catalytic cracking process. This process is reviewed with a review of the FIGURE, which is conventional up to flue gas line 36.

A heavy, nitrogen containing feed is charged via line 2 to riser reactor 10. Hot regenerated catalyst removed from the regenerator via line 12 vaporizes fresh feed in the base of the riser reactor, and cracks the feed. Cracked products and spent catalyst are discharged into vessel 20, and separated. Spent catalyst is stripped in a stripping means not shown in the base of vessel 20, then stripped catalyst is charged via line 14 to regenerator 30. Cracked products are removed from vessel 20 via line 26 and charged to an FCC main column, not shown.

Spent catalyst is maintained as a bubbling, dense phase fluidized bed in vessel 30. Regeneration gas, almost always air, sometimes enriched with oxygen, is added via line 34 to the base of the regenerator. Air flow is controlled by flow control valve 95. Regenerated catalyst is removed via line 12 and recycled to the base of the riser reactor. Flue gas is removed from the regenerator via line 36.

Much of the process and equipment recited above are those used in conventional FCC regenerators. Many FCC regenerators use such bubbling bed regenerators, which have more severe $NO_x$ emissions characteristics than high efficiency regenerators. Both types (bubbling fluid bed and fast fluid bed or high efficiency) will benefit from the practice of the present invention, which will now be reviewed.

Flue gas containing CO, HCN, $NH_3$ and the like is removed from the FCC regenerator via line 36, and most of the $NO_x$ precursors are homogeneously converted. This may be done in the transfer line 36, by air addition via line 41 and control valve 43. Preferably the $NO_x$ precursors are converted in equipment resembling a conventional CO boiler, vessel 49.

A refiner may even use an existing CO boiler 49 to homogeneously convert most of the HCN and $NH_3$ present, but it must operate differently than a conventional CO boiler in that a significant amount of CO must remain after most of the HCN and $NH_3$ are converted.

Flue gas may be cooled upstream or downstream or homogeneous conversion in optional cooling means 45. Most refiners will not require a cooler.

Air, or oxygen, or oxygen enriched air or oxygen enriched inert gas for homogeneous conversion may occur immediately downstream of the regenerator via line 41, and/or just upstream of or within the $NO_x$ precursor conversion means 49, which can be a large box or vessel. Air is preferably added via line 51 and flow control valve 53 so that the temperature rise associated with combustion can be dealt with in vessel 49 rather than in the transfer line. Thus vessel 49 may have heat exchange means such as tubes for making steam, not shown.

The "product" of substoichiometric homogeneous conversion will be a flue gas stream with most of the $NO_x$ precursors converted, significant amounts of $NO_x$, and significant amounts of CO, usually in excess of 0.5 mole %, preferably in excess of 1 mole %, and ideally 2 or more mole % CO. The presence of CO is essential for use in the downstream, catalytic reduction of produced $NO_x$ with native or unreacted CO in reactor 89.

Some additional air may be added upstream of reactor 89 via line 61 and control valve 63, but usually this will not be necessary. Line 61 may also be used to admit additional amounts of reducing gas, such as CO, but usually this will not be necessary.

The gas 57 discharged from $NO_x$ converter 89 may be subjected to additional treatments in means not shown for conversion of any CO remaining prior to release via stack 98. This will require addition of more oxygen containing gas and may involve a CO boiler or catalytic converter to remove minor amounts of CO.

Much conventional equipment, third stage separators to remove traces of particulates, power recovery turbines, and waste heat boilers, are omitted. There will frequently be some waste heat recovery means, not shown, downstream of the CO conversion means, and frequently there will be a power recovery turbine as well. These are preferred, but conventional.

CONTROL METHODS

The aims disclosed in U.S. Pat. No. 5,268,089 may be used herein, though the targets are somewhat different. In '089 an "on the brink" FCC regenerator operation was sought. I prefer to operate with more CO present in flue gas from the FCC regenerator, so the conventional steps used to maintain the FCC regenerator in partial CO burn mode may be used.

The CO content of flue gas exiting the FCC regenerator should be at least 1 mole %, but preferably is at least 2 mole % CO. The process works well with large amounts of CO, such as 3–6 mole % CO. This is typical of FCC regenerators operating in partial CO burn mode.

One way to control the unit is to use thermocouples, not shown, in the regenerator to develop a signal indicative of either differential temperature in the regenerator, or dilute phase temperature, to control regenerator air via valve 95 and line 34. The limited amounts of air added downstream of the regenerator may be added using a master controller means 90 receiving, e.g., signals via lines 74 and 84 of conditions in the flue gas stream upstream of and downstream of converter 49. The signals sent via lines 74 and 84 are generated by transducers 70 and 80 which monitor the conditions of the flue gas stream via taps 72 and 82, respectively. Rather than change the amount of air added to the flue gas line 36 via a signal sent through line 47 to value 43 from means 90, it is also possible to send a signal via transmission means 92 to valve 95 to admit more air to the regenerator.

The homogeneous $NO_x$ precursor conversion process tolerates very well the presence of large amounts of CO, and may be convert a significant amount, but preferably less than ½, of the CO present in the flue gas from the FCC regenerator.

It is important that the homogeneous conversion step convert at least a majority, and preferably at least 90% of the $NO_x$ precursors present in the flue gas from the FCC regenerator. This ensures that the gas removed from the homogeneous conversion zone will have the proper composition to permit catalytic reduction, in the downstream reactor 89, of produced $NO_x$ with native CO present in the flue gas stream.

Although the present invention is useful for both moving bed and fluidized bed catalytic cracking units, the discussion that follows is directed to FCC units which are the state of the art.

FCC FEED

Any conventional FCC feed can be used. The process of the present invention is good for processing nitrogenous charge stocks, those having more than 500 ppm total nitrogen compounds, and especially useful in processing stocks containing high levels of nitrogen compounds, e.g., having more than 1000 wt ppm total nitrogen compounds.

The feeds may range from the typical, such as petroleum distillates or residual stocks, either virgin or partially refined, to the atypical, such as coal oils and shale oils. The feed frequently contains recycled hydrocarbons, light and heavy cycle oils which have already been subjected to cracking.

Preferred feeds are gas oils, vacuum gas oils, atmospheric resids, and vacuum resids. The invention is most useful with feeds having an initial boiling point above about 650° F.

FCC CATALYST

Commercially available FCC catalysts may be used. The catalyst preferably contains relatively large amounts of large pore zeolite for maximum effectiveness, but such catalysts are readily available. The process will work with amorphous catalyst, but few modern FCC units use amorphous catalyst.

Preferred catalysts contain at least 10 wt % large pore zeolite in a porous refractory matrix such as silica-alumina, clay, or the like. The zeolite content is preferably higher and usually will be at least 20 wt %. For best results the catalyst should contain from 30 to 60 wt % large pore zeolite.

All zeolite contents discussed herein refer to the zeolite content of the makeup catalyst, rather than the zeolite content of the equilibrium catalyst, or E-Cat. Much crystallinity is lost in the weeks and months that the catalyst spends in the harsh, steam filled environment of modern FCC regenerators, so the equilibrium catalyst will contain a much lower zeolite content by classical analytic methods. Most refiners usually refer to the zeolite content of their makeup catalyst, and the MAT (Modified Activity Test) or FAI (Fluidized Activity Index) of their equilibrium catalyst, and this specification follows this naming convention.

Conventional zeolites such as X and Y zeolites, or aluminum deficient forms of these zeolites such as dealuminized Y (DEAL Y), ultrastable Y (USY) and ultrahydrophobic Y (UHP Y) may be used as the large pore cracking catalyst. The zeolites may be stabilized with Rare Earths, e.g., 0.1 to 10 wt % RE.

Relatively high silica zeolite containing catalysts are preferred. Catalysts containing 20–60% USY or rare earth USY (REUSY) are especially preferred.

The catalyst inventory may contain one or more additives, present as separate additive particles, or mixed in with each particle of the cracking catalyst. Additives can be added to enhance octane (medium pore size zeolites, sometimes referred to as shape selective zeolites, i.e., those having a Constraint Index of 1–12, and typified by ZSM-5, and other materials having a similar crystal structure). Other additives which may be used include CO combustion promoters and SOx removal additives, each discussed at greater length hereafter.

CO COMBUSTION PROMOTER

Use of a CO combustion promoter in the regenerator is not essential for the practice of the present invention, however, some may be present. These are well-known.

U.S. Pat. Nos. 4,072,600 and 4,235,754, incorporated by reference, teach operating an FCC regenerator with 0.01 to 100 ppm Pt. Good results are obtained with 0.1 to 10 wt. ppm platinum on the catalyst. It is preferred to operate with just enough CO combustion additive to control afterburning. Conventional procedures can be used to determine if enough promoter is present. In most refineries, afterburning shows up as a 30° F., 50° F. or 75° F. temperature increase from the catalyst bed to the cyclones above the bed, so sufficient promoter may be added so no more afterburning than this occurs.

SOx ADDITIVES

Additives may be used to adsorb SOx. These are believed to be various forms of alumina, rare-earth oxides, and alkaline earth oxides, containing minor amounts of Pt, on the order of 0.1 to 2 ppm Pt. Additives are available from several catalyst suppliers, such as Davison's "R" or Katalistiks International, Inc.'s "DESOX."

The FCC catalyst composition, per se, forms no part of the present invention.

FCC REACTOR CONDITIONS

The reactor operation will be conventional all riser cracking FCC, as disclosed in U.S. Pat. No. 4,421,636, incorporated by reference. Typical riser cracking reaction conditions include catalyst/oil weight ratios of 0.5:1 to 15:1 and preferably 3:1 to 8:1, and a catalyst contact time of 0.1–50 seconds, preferably 0.5 to 10 seconds, and most preferably 0.75 to 5 seconds, and riser top temperatures of 900° F. to about 1100° F., preferably 950° F. to 1050° F.

It is important to have good mixing of feed with catalyst in the base of the riser reactor, using conventional techniques such as adding large amounts of atomizing steam, use of multiple nozzles, use of atomizing nozzles and similar technology. The Atomax nozzle, available from the M. W. Kellogg Co, is preferred. Details about an excellent nozzle are disclosed in U.S. Pat. Nos. 5,289,976 and 5,306,418 which are incorporated by reference.

It is preferred, but not essential, to have a riser catalyst acceleration zone in the base of the riser.

It is preferred, but not essential, for the riser reactor to discharge into a closed cyclone system for rapid separation of cracked products from spent catalyst. A closed cyclone system is disclosed in U.S. Pat. No. 4,502,947 to Haddad et al, incorporated by reference.

It is preferred but not essential, to strip rapidly the catalyst as it exits the riser and upstream of the catalyst stripper. Stripper cyclones disclosed in U.S. Pat. No. 4,173,527, Schatz and Heffley, incorporated by reference, may be used.

It is preferred, but not essential, to use a hot catalyst stripper. Hot strippers heat spent catalyst by adding hot, regenerated catalyst to spent catalyst. A hot stripper is shown in U.S. Pat. No. 3,821,103, Owen et al, incorporated by reference. After hot stripping, a catalyst cooler may cool heated catalyst before it is sent to the regenerator. A preferred hot stripper and catalyst cooler is shown in U.S. Pat. No. 4,820,404, Owen, incorporated by reference.

Conventional FCC steam stripping conditions can be used, with the spent catalyst having essentially the same temperature as the riser outlet, and with 0.5 to 5% stripping gas, preferably steam, added to strip spent catalyst.

The FCC reactor and stripper conditions, per se, can be conventional.

CATALYST REGENERATION

The process and apparatus of the present invention can be used with bubbling dense bed FCC regenerators or high efficiency regenerators. Bubbling bed regenerators will be considered first.

BUBBLING BED CATALYST REGENERATORS

In these regenerators much of the regeneration gas, usually air, passes through the bed in the form of bubbles. These pass through the bed, but contact it poorly.

These units operate with large amounts of catalyst. The bubbling bed regenerators are not very efficient at burning coke so a large catalyst inventory and long residence time in the regenerator are needed to produce clean burned catalyst.

The carbon levels on regenerated catalyst can be conventional, typically less than 0.3 wt % coke, preferably less than 0.15 wt % coke, and most preferably even less. By coke is meant not only carbon, but minor amounts of hydrogen associated with the coke, and perhaps even very minor amounts of unstripped heavy hydrocarbons which remain on catalyst. Expressed as wt % carbon, the numbers are essentially the same, but 5 to 10% less.

Although the carbon on regenerated catalyst can be the same as that produced by conventional FCC regenerators, the flue gas composition may range from conventional partial CO burn with large amounts of CO to flue gas with significant amounts of both CO and oxidized nitrogen species. Thus operation may range from deep in partial CO burn to something which is still partial CO burn in that there is more than 1% CO present but contains some $NO_x$ as well. There should always be enough CO present in the flue gas so that the FCC regenerator may be reliably controlled using control techniques associated with partial CO combustion, e.g., use of afterburning in the regenerator to control regenerator air rate.

Strictly speaking, the CO content could be disregarded if sufficient resources are devoted to analyzing the $NO_x$ precursors directly, e.g., HCN. It would also be possible to run oxygen and carbon balances, and develop some sort of feed forward model which might be used to calculate some property of flue gas or of regenerator operation which would yield the same information in terms of controlling the unit as measuring the CO content of the regenerator flue gas. In most refineries this is neither practical nor necessary as the CO content of the flue gas is a sensitive indicator of the $NO_x$ precursors generated by a particular regenerator processing a particular feed.

The CO content of flue gas should be considered with the oxygen content of the flue gas. There must be at least as much CO, by volume or molar amount, as oxygen. Preferably the CO:O2 ratio is above 2:1, and more preferably at least 3:1, 4:1, 5:1, 10:1 or higher.

The lower limit on CO content may be as low as 0.1 mole % or 0.5%, but only when the oxygen content is less than 50% of the CO content, and most regenerators in partial CO burn mode can not produce such low CO content flue gas. Poor air distribution, or poor catalyst circulation in the regenerator, and presence of large air bubbles in the dense bed will require most refiners to operate with at least 1 mole % CO, and preferable with 2 to 6 mole % CO.

The regenerator flue gas may contain significant amounts of oxygen but does not have to. If oxygen is present, it should be present in substoichiometric amounts. My process allows bubbling bed regenerators to make excellent use of regeneration air. It is possible to operate the FCC regenerator with essentially no waste of combustion air.

Temperatures in the regenerator can be similar to conventional regenerators in complete CO combustion mode. Much of the coke on catalyst may be burned to form $CO_2$ rather than CO. Temperatures can also be cooler than in a conventional regenerator, as the regenerator operation shifts deeper into partial CO burn mode.

Catalyst coolers, or some other means for heat removal from the regenerator, can be used to cool the regenerator. Addition of torch oil or other fuel can be used to heat the regenerator.

Keeping regenerator temperatures low makes such afterburning as may occur less troublesome and limits downstream temperature rise. I prefer to operate with temperatures below 1300° F., and preferably below 1250° F., but many units run above 1300° F., e.g., from 1330° to 1400° F.

FAST FLUIDIZED BED REGENERATORS

This process may also be used with high efficiency regenerators (H.E.R.), with a fast fluidized bed coke combustor, dilute phase transport riser, and second bed to collect regenerated catalyst. It will be necessary to operate these in partial CO burn mode to make CO specifications.

H.E.R.'s inherently make excellent use of regeneration air. Most operate with 1 or 2 mole % $O_2$ or more in the flue gas when in complete CO burn mode. When in partial CO burn mode most operate with little excess oxygen, usually in the ppm range, always less than 1/10th %. For HER's, significant reductions in the amount of air added may be necessary to produce a flue gas with the correct $CO/O_2$ ratio. Reducing or eliminating CO combustion promoter may be necessary to generate a flue gas with twice as much CO as oxygen.

Although most regenerators are controlled primarily by adjusting the amount of regeneration air added, other equivalent control schemes are available which keep the air constant and change some other condition. Constant air rate, with changes in feed rate changing the coke yield, is an acceptable way to modify regenerator operation. Constant air, with variable feed preheat, or variable regenerator air preheat, are also acceptable. Finally, catalyst coolers can be used to remove heat from a unit. If a unit is not generating enough coke to stay in heat balance, torch oil, or some other fuel may be burned in the regenerator.

Up to this point in the FCC process, through the regenerator flue gas, the operation can be within the limits of conventional operation. In many instances the refiner will choose to operate the regenerator solidly in partial CO burn mode, which is highly conventional. Other refiners will operate with much lower amounts of CO in the regenerator flue gas, but always controlling regenerator operation so that the CO content is at least twice that of the oxygen content, molar basis.

This type of regenerator operation provides a proper foundation for the practice of catalytic, post-regenerator conversion of $NO_x$ precursors, discussed hereafter.

HOMOGENEOUS $NO_x$ PRECURSOR CONVERSION

This is a simple thermal process, which operates with no catalyst. High temperature and time are sufficient.

The temperatures of typical FCC flue gas streams will be adequate, though conventional means may be used to increase or decrease temperatures if desired.

Typical temperatures include 1100° F. to 1800° F., preferably 1200° F. to 1600° F., most preferably 1250° F. to 1450° F.

Residence time should be sufficient to permit the desired reactions to take place. In general, the minimum required residence time will decrease as temperature increases. For instance, at 1400° F., the gas residence time calculated at process conditions is preferably at least 0.4 to 0.8 seconds.

The process works better as temperatures increase. Some refiners may wish to take advantage of this and run their regenerators deep in partial CO burn mode to produce large amounts of CO. This CO rich gas has a high flame temperature even when limited amounts of air or oxygen are added. Thus the CO rich FCC regenerator flue gas stream represents a heat source (by burning some of the CO present) and a source of reducing reactant (unreacted CO will reduce formed $NO_x$).

The process, surprisingly, works better as CO levels increase. While it might be thought that high CO levels would lead to increased competition for oxygen, and reduced conversion of $NO_x$ precursors, the opposite was observed experimentally. The presence of large amounts of CO greatly accelerated the rate of $NH_3$ conversion, to both NO and $N_2$. This was completely unexpected, as large amounts of reducing agent (CO) would not normally be expected to compete with $NO_x$ precursors rather than promote their conversion.

To summarize, there is no upper limit on either temperature or CO concentration entering the homogeneous conversion zone. These upper limits are well within the normal operating limits of FCC regenerators operating in partial CO combustion mode.

There is no upper limit on gas residence time in the homogeneous conversion zone. There is a minimum time set by that combination of time and temperature which achieves the desired conversion. There is no upper limit on time, and more gas residence time is believed to increase conversion of $NO_x$ due to reactions with CO.

The process is sensitive to CO in that there must always be a stoichiometric excess of CO relative to $NO_x$ precursors and relative to oxygen present, both entering and leaving the homogeneous conversion zone.

CATALYTIC $NO_x$ REDUCTION

The next essential step of the process of the present invention is reduction of $NO_x$ using CO present in the gas stream from the homogeneous conversion reactor.

Many conventional oxidation/reduction catalysts can be used. The presence of both CO and $NO_x$ is essential, in that formed $NO_x$ reacts with CO already present in the stream. By operating in this way it is possible to avoid the addition of ammonia or urea or the like, which introduce additional costs and potentially more pollutants into the flue gas.

The temperature may range from 300° to 800° C., preferably 400° to 700° C. Temperatures near the higher ends of these ranges generally give higher conversions.

The catalyst may be disposed as a fixed, fluidized, or moving bed. To simplify design, and reduce pressure drop, it may be beneficial to dispose the catalyst as a plurality of honeycomb monoliths, or as a radial flow fixed bed, or as a bubbling fluidized bed.

Gas hourly space velocities, GHSV's, may vary greatly. There is no lower limit on GHSV other than that set by economics or space constraints. These reactions proceed quickly, very high space velocity operation is possible, especially with fresh catalyst and/or operation in the higher end of the temperature range.

Most refiners will operate with GHSV's above 1000, typically with GHSV's from 2000 to 250,000 $hr^{-1}$, preferably from 2500 to 125,000 $hr^{-1}$, and most preferably from 25000 to 50,000 $hr^{-1}$.

Large amounts of water vapor may be tolerated but are not preferred. I have tested this with varying amounts of $H_2O$ vapor while achieving significant $NO_x$ reduction, although conversion fell to some extent as water content increased.

It is beneficial to limit conversion in the $NO_x$ precursor conversion means so that some of the CO survives. If all CO is converted, there will be, in some places in the $NO_x$ precursor conversion zone, some places with no CO, or where oxygen exceeds CO, molar basis. When this occurs, $NO_x$ precursors can still be converted, but form both $NO_x$ and nitrogen. Another alternative is that $NO_x$ precursors are converted into $NO_x$ and reduced by reaction with CO, in some as yet not completely understood reaction mechanism.

Complete CO conversion is therefore not desirable in the $NO_x$ precursor conversion means. Complete CO conversion is also not necessary, as the process preferably retains a more or less conventional CO boiler, or equivalent, downstream of the $NO_x$ precursor conversion reactor, discussed next.

CO CONVERSION MEANS

Basically any of the devices disclosed in U.S. Pat. No. 5,268,089 may be used to remove minor, or major, amounts of CO remaining in the gas stream after conversion of $NO_x$ precursors. Many refiners will have conventional CO boilers in place, but some may prefer to use a catalytic converter, such as Pt on alumina on a monolith support, similar to the honeycomb elements used to burn CO and resin from flue gas produced in wood stoves.

The CO conversion means can operate conventionally, typically with enough excess oxygen to provide 1–2 mole % oxygen in the flue gas from the CO conversion means. Preferably the CO boiler, or other CO conversion means, will have most of its normal load, and the process of the present invention is able to oxidize, and then selectively reduce, most $NO_x$ precursors in the presence of large amounts of CO.

CO, $NO_x$ EMISSIONS AFTER CO COMBUSTION

Regardless of the intermediate steps, the flue gas 57 going up the stack 98 can have unusually low levels of both $NO_x$ and CO, provided some form of CO boiler is used. The $NO_x$ and CO levels should be below 100 ppm. Preferably the $NO_x$ and CO levels are each below 50 ppm.

EX. 1

CATALYTIC CONV. OF $NO_x$ PRECURSORS—COMPARISON TEST

Illustrative data are shown in Table 1. The catalyst was an iron oxide/silica-alumina material, with approximately 2.5 wt % Fe. The catalyst (11.2 g) was loaded in a 12 mm ID alumina tube, which was heated in a resistance furnace. The feed consisted of 2 vol % CO, 200 ppmv $NH_3$, approximately 2 vol % water, and varying amounts of $O_2$. The balance of the feed was nitrogen. In all cases, excess CO was detected at the reactor exit. At least 70 vol % conversion of $NH_3$, with less than 20 vol % yield of NO, is desirable. For a 200 ppm $NH_3$ feed, this translates to less than 60 ppm $NH_3$ and less than 40 ppm NO in the effluent. While the performance of the supported iron oxide catalyst was satisfying under some conditions, there is room for improvement, especially in the $NH_3$ oxidation step.

This example, Ex. 1, is not an example of the claimed process which requires at least one stage of purely thermal conversion upstream of the catalytic conversion stage.

EX. 2

HOMOGENEOUS CONVERSION OF $NO_x$ PRECURSORS—INVENTION

Homogeneous oxidation of $NH_3$ can be essentially complete, even in the presence of excess CO. For instance, in the same reaction tube but with no catalyst, a feed stream of 2 vol % CO and 0.5 vol % $O_2$ at 400 sccm gave less than 5 ppm $NH_3$ and 96 ppm NO at 1400° F. Homogeneous reaction at these temperatures oxidizes $NH_3$ rapidly with poor selectivity to $N_2$. The $NH_3$ oxidation appears to proceed faster without catalyst, than in the presence of a preferred iron oxide catalyst.

Perhaps the catalyst consumes oxygen rapidly by reaction with CO, making less oxygen available for reaction with $NH_3$, or the solids quench the free radical chemistry paths involved with $NH_3$ oxidation.

The chemistry believed to occur is oxidation of $NH_3$ to NO and $N_2$ in the homogeneous reaction zone, where free $O_2$ is present. At some point along the bed, essentially all the free $O_2$ is consumed by the excess CO. After that point, the dominant reaction of nitrogen species is reduction of NO by CO. Some reduction of NO by remaining $NH_3$ cannot be excluded. This scenario is partly speculative, but it can give some guidance in applying this concept.

Assuming that most of the $NH_3$ is transformed to $NO_x$ and $N_2$ in the homogeneous reaction space, the catalyst must be effective at reducing $NO_x$ to $N_2$, at elevated temperature and in the presence of water. Results from NO reduction experiments are listed in Table 2. The same catalyst and reactor were used as in the example above with $NH_3$ feed, but the feed consisted of 100 ppm NO, 2% CO, and varying amounts of $O_2$ and water. The feed rate was 400 sccm, on a water-free basis. The catalyst was shown to be effective at NO reduction, as long as the oxygen was present in substoichiometric amounts.

Other results show this catalyst to be active in the desired conversion of $NH_3$ from 1200° to 1600° F., with relatively low NO make; this suggests that the catalyst retains significant NO reduction activity over this temperature range. Metal and metal oxide catalysts, especially those from Groups 4B, 5B, 6B, 7B, 8B, 1B, 2B, 3A, 4A and 5A are believed useful in this application.

The results of the $NH_3$ oxidation experiments over supported iron oxide catalyst at 1400° F. are reported in the following Table 1. The feed gas had 200 ppm $NH_3$ and 2 mole % CO, and varying amounts of oxygen and water vapor. The effluent gas composition was analyzed to determine both unconverted ammonia concentration and NO formation.

TABLE 1

| Flow rate, | FEED | | EFFLUENT | |
|---|---|---|---|---|
| sccm | % $O_2$ | % $H_2O$ | $NH_3$, ppm | NO, ppm |
| 400 | 0.5 | 0 | 16 | <1 |
| 400 | 0.25 | 2 | 145 | <1 |
| 400 | 0.5 | 2 | 47 | 8 |
| 400 | 0.75 | 2 | 32 | 25 |
| 250 | 0.75 | 2 | 38 | 3 |

TABLE 2

NO reduction experiments over supported iron oxide catalyst at 1400° F.
Feed has 100 ppm NO and 2% CO, and flow rate (dry basis) is 400 sccm.

| % $O_2$ | % $H_2O$ | ppm NO in effluent |
|---|---|---|
| 0 | 0 | <3 |
| 0 | 8 | <3 |
| 0.5 | 8 | <3 |
| 1.0 | 8 | >70 |

The following section summarizes the suitable, preferred, and most preferred ranges of gas composition in various parts of the process.

GAS STREAM COMPOSITION

| | CO, % | $O_2$, % | CO/$O_2$ | HCN, ppm | $NH_3$, ppm |
|---|---|---|---|---|---|
| FCC Regenerator Flue Gas Entering Homogeneous Zone | | | | | |
| Good | 1–15 | 0.01–2 | <1 | 10–5000 | 10–5000 |
| Better | 1.5–8 | 0.05–1 | 1.2–5 | 30–2000 | 30–2000 |
| Best | 2–6 | 0.10–2 | 1.5–3 | 50–500 | 50–500 |
| Homogeneous Zone Exit Entering Catalytic Zone | | | | | |
| Good | 0.5–10 | 0.1–5 | >1* | <400 | <400 |
| Better | 0.75–7 | 0.35–2 | 1.5–8 | <50 | <50 |
| Best | 1.5–5 | 0.5–1 | 2–4 | <10 | <10 |

-continued

GAS STREAM COMPOSITION

| | CO, % | $O_2$, % | CO/$O_2$ | HCN, ppm | $NH_3$, ppm |
|---|---|---|---|---|---|
| Leaving Catalytic Zone | | | | | |
| Good | 0–12 | | | <400 | <400 |
| Better | 0–7 | | | <50 | <50 |
| Best | 0–5 | | | <10 | <10 |
| CO Boiler Exit | | | | | |
| Good | <200 | | | <200 | <200 |
| Better | <100 | | | <20 | <20 |
| Best | <30 | | | <5 | <5 |

*As it is possible for essentially all of the $O_2$ to be consumed in the homogeneous conversion step, the CO/$O_2$ ratio can approach infinity.

Some limits, such as the 10% CO content for the FCC regenerator, are somewhat beyond the CO levels experienced in commercial plants operating with air as the regeneration gas. The process of the present invention works well when much, or even all of the regeneration gas is oxygen, which can produce very high CO levels.

The process of the present invention provides a simple and robust way for refiners to crack nitrogen containing feedstocks while minimizing $NO_x$ emissions.

The process is especially attractive in that it does not rely on addition of ammonia or ammonia precursors such as urea to reduce the $NO_x$. Naturally occuring CO is the primary $NO_x$ reduction agent, and this material is already present in the FCC regenerator flue gas, and may reliably be removed in the downstream CO boiler. Under no circumstances will the process of the present invention release large amounts of ammonia to the atmosphere, which can happen if an ammonia injection system fails and adds excessive amounts of ammonia.

I claim:

1. A catalytic cracking process for cracking a nitrogen-containing hydrocarbon feed comprising:

a. cracking said feed in a cracking reactor with a source of regenerated cracking catalyst to produce catalytically cracked products which are removed as a product and spent catalyst containing nitrogen-containing coke;

b. regenerating said spent catalyst in a catalyst regenerator by contact with a controlled amount of air or oxygen-containing regeneration gas at regeneration conditions to produce regenerated catalyst which is recycled to said cracking reactor and regenerator flue gas;

c. removing a regenerator flue gas stream comprising volatilized $NO_x$ precursors, at least 1 mole % carbon monoxide and more carbon monoxide than oxygen on a molar basis;

d. adding air or oxygen-containing gas to regenerator flue gas to produce oxygen-enriched flue gas;

e. homogeneously converting at least 50 mole % of volatilized $NO_x$ precursors, but less than 50 mole % of said CO, in said oxygen-enriched flue gas in a non-catalytic conversion zone to produce homogeneously converted flue gas containing produced $NO_x$ and CO; and f. catalytically reducing $NO_x$ in said homogeneously converted flue gas in a catalytic $NO_x$ reduction reactor containing a $NO_x$ reduction catalyst by reaction with said CO in said homogeneously converted flue gas to produce product gas with a reduced CO content relative to said regenerator flue gas and a reduced $NO_x$ content as compared to the $NO_x$ content of a like regenerator flue gas oxidized in a CO boiler to said reduced CO content.

2. The process of claim 1 wherein said regenerator flue gas contains at least 2.0 mole % CO.

3. The process of claim 1 wherein at least 75% of volatilized $NO_x$ precursors are homogeneously converted.

4. The process of claim 1 wherein said regenerator flue gas contains at least 2.5 mole % CO, at least 75% of volatilized $NO_x$ precursors are homogeneously converted, and said converted flue gas stream contains at least 1.5 mole % CO.

5. The process of claim 1 wherein said converted flue gas stream is charged to a CO boiler.

6. The process of claim 1 wherein said $NO_x$ reduction catalyst comprises a Group VIII noble metal on a support.

7. The process of claim 1 wherein said $NO_x$ reduction catalyst is a supported iron oxide catalyst.

8. A fluidized catalytic cracking process for cracking a nitrogen-containing hydrocarbon feed comprising:

a. cracking said feed in a fluidized catalytic cracking (FCC) reactor with a source of regenerated cracking catalyst to produce catalytically cracked products which are removed as a product and spent catalyst containing nitrogen containing coke;

b. regenerating said spent catalyst in a bubbling fluidized bed catalyst regenerator with air or oxygen-containing regeneration gas at regeneration conditions to produce regenerated catalyst which is recycled to said cracking reactor and regenerator glue gas;

c. removing from said regenerator a regenerator flue gas stream comprising:
less than 1 mole % oxygen,
at least 2 mole % carbon monoxide, and
at least 100 ppmv of $NO_x$ precursors consisting of HCN, $NH_3$, or mixtures thereof;

d. adding air or oxygen containing gas to regenerator flue gas to produce oxygen-enriched flue gas and controlling oxygen addition so the oxygen-enriched flue gas has at least a 2:1 carbon monoxide:oxygen mole ratio;

e. thermally converting at least 50 mole % of the $NO_x$ precursors but less than 50 mole % of said CO in a non-catalytic, thermal conversion zone to produce converted flue gas having at least 1 mole % CO and $NO_x$ produced as a result of said thermal conversion; and f. catalytically reducing $NO_x$ in said converted flue gas in a catalytic $NO_x$ reduction reactor containing a $NO_x$ reduction catalyst with said CO to produce product gas with a reduced CO content relative to regenerator flue gas and a reduced $NO_x$ content compared to a like regenerator flue gas oxidized in a CO boiler to said reduced CO content.

9. The process of claim 8 wherein at least 75% of said $NO_x$ precursors and less than 33% of said CO are converted by homogeneous conversion.

10. The process of claim 8 wherein at least 90% of the $NO_x$ precursors are homogeneously converted.

11. The process of claim 8 wherein said regenerator flue gas contains at least 2.5 mole % CO and said converted flue gas stream contains at least 1.5 mole % CO.

12. The process of claim 8 wherein said converted flue gas stream is charged to a CO boiler.

13. The process of claim 8 wherein said $NO_x$ reduction catalyst comprises a Group VIII noble metal on a support.

14. The process of claim 8 wherein said $NO_x$ reduction catalyst is a supported iron oxide catalyst.

15. A catalytic cracking process for cracking a nitrogen-containing hydrocarbon feed comprising:

a. cracking said feed in a cracking reactor with a source of regenerated cracking catalyst to produce catalytically cracked products which are removed as a product, and spent catalyst containing nitrogen-containing coke;

b. regenerating said spent catalyst in a catalyst regenerator by contact with a controlled amount of air or oxygen-containing regeneration gas at regeneration conditions to produce regenerated catalyst which is recycled to said cracking reactor, and regenerator flue gas;

c. removing a regenerator flue gas stream comprising volatilized $NO_x$ precursors consisting of HCN, $NH_3$, and mixtures thereof, at least 1 mole % CO and more CO than oxygen on a molar basis;

d. adding air or oxygen-containing gas to regenerator flue gas to produce oxygen-enriched regenerator flue gas;

e. homogeneously converting at least 50 mole % of the volatilized $NO_x$ precursors, but less than 50 mole % of said CO, in said oxygen-enriched regenerator flue gas in a non-catalytic conversion zone to produce homogeneously converted flue gas containing produced $NO_x$ and CO; and f. catalytically reducing $NO_x$ in said homogeneously converted flue gas in a catalytic $NO_x$ reduction reactor containing an $NO_x$ reduction catalyst by reaction with said CO in said homogeneously converted flue gas to produce product gas with a reduced CO content relative to said homogeneously converted regenerator flue gas.

16. The process of claim 15 wherein said regenerator flue gas contains at least 2.0 mole % CO.

17. The process of claim 15 wherein at least 75% of said $NO_x$ precursors are homogeneously converted in step e of claim 15.

18. The process of claim 15 wherein said regenerator flue gas contains at least 2.5 mole % CO, wherein at least 75% of said $NO_x$ precursors are homogeneously converted in step e of claim 15, and wherein said homogeneously converted flue gas contains at least 1.5 mole % CO.

19. The process of claim 15 wherein said $NO_x$ reduction catalyst comprises a Group VIII noble metal on a support.

20. The process of claim 15 wherein said $NO_x$ reduction catalyst is a supported iron oxide catalyst.

* * * * *